US005695693A

United States Patent [19]

Koizumi et al.

[11] Patent Number: 5,695,693

[45] Date of Patent: Dec. 9, 1997

[54] CARBURETOR FUEL ADJUSTING DEVICE

[75] Inventors: Kimio Koizumi; Satoru Araki; Yasuaki Kohira, all of Kanagawa, Japan

[73] Assignee: U.S.A. Zama, Inc., Franklin, Tenn.

[21] Appl. No.: 406,567

[22] Filed: Mar. 20, 1995

[30] Foreign Application Priority Data

Sep. 13, 1994 [JP] Japan ..... 6-244828

[51] Int. Cl.[6] ..... F02M 3/08

[52] U.S. Cl. ..... 261/71; 261/DIG. 38; 261/DIG. 84; 137/382

[58] Field of Search ..... 261/DIG. 38, 71, 261/DIG. 84; 137/382

[56] References Cited

U.S. PATENT DOCUMENTS

| | | | |
|---|---|---|---|
| 3,618,906 | 11/1971 | Charron | 261/41 |
| 4,271,095 | 6/1981 | Maeda | 261/41 |
| 4,283,353 | 8/1981 | Miller | 261/41 |
| 4,333,891 | 6/1982 | Miller | 261/41 |
| 5,055,238 | 10/1991 | Araki | 261/35 |
| 5,236,634 | 8/1993 | Hammett | 261/71 |
| 5,252,261 | 10/1993 | Gerhardy | 261/71 |
| 5,322,645 | 6/1994 | Hammett | 261/71 |

FOREIGN PATENT DOCUMENTS

| | | |
|---|---|---|
| 2352-955 | 12/1977 | France . |
| 24 01 803 | 1/1974 | Germany . |
| 25 48 226 | 10/1975 | Germany . |
| 61-134555 | 8/1985 | Japan . |

*Primary Examiner*—Tim R. Miles
*Attorney, Agent, or Firm*—Lyon & Lyon

[57] ABSTRACT

A carburetor fuel adjusting device that facilitates control of the quantity of fuel that flows from the fuel chamber to an air intake port of a carburetor by making it possible for the user to adjust an adjustment valve within the limits defined by emission control regulations. The carburetor fuel adjusting device has a cap having two appendages to limit its turning in the lean mixture direction and in the rich mixture direction, and an engagement area to engage a valve extension of the fuel adjustment valves of a carburetor. The valve extensions are inserted through insertion holes of a retainer attached to the carburetor body. When the cap is retained by the retainer in a disengaged position, wherein the engagement area is not attached to the valve extensions of the fuel adjustment valves, the adjustment valves can be adjusted separately from the cap. The cap, however, can be moved forward to an engaged position wherein the engagement area of the cap becomes attached to the valve extensions. In the engaged position, the adjustment valves can be turned in unison with the cap within a range formed by the angle between the appendages which, when rotated, abut against stoppers.

18 Claims, 3 Drawing Sheets

CARBURETOR FUEL ADJUSTING DEVICE

FIELD OF THE INVENTION

This invention relates to carburetors designed to supply fuel to multi-purpose engines that power agricultural equipment, gardening equipment, and small vehicles and, more particularly, devices for the manual adjustment of fuel flow quantity for such carburetors.

BACKGROUND

Carburetors for multi-purpose engines supply a considerably lower quantity of fuel to the engine in comparison with carburetors that supply fuel to four-stroke engines, such as automobile engines. Significant changes in fuel mixture ratio result from inaccuracies in carburetor component placement and dimension. Differences in engine performance must also be taken into consideration. All of these factors make it necessary to be able to adjust carburetor fuel flow quantity separately for each individual engine.

Given this necessity, a manually adjustable fuel valve is included in the design of some carburetors. Such valves comprise a needle-shaped, tapered valve that remains inserted into the fuel jet and is mounted on the end of a threaded rod that has an extension at the opposite end. The extension protrudes from the carburetor body into which the threaded rod is screwed. By twisting the extension, the needle valve can be moved back and forth within the carburetor body, thus changing the effective cross-sectional area of the jet. This adjusts the quantity of fuel flow through the jet. Both the main fuel jet and the low-speed fuel jet can be equipped with such valves, thus making it possible to adjust fuel flow quantity separately for each jet. In order to obtain the appropriate quantity of fuel flow, these valves are normally adjusted by the manufacturers of the carburetors and engines, and by the manufacturers of the vehicles or the appliances in which the carburetors are used. However, in certain situations, the user of the engine will make adjustments in an attempt to maintain performance in different locations and under different operating conditions or to improve performance in cases of temporary loss of engine performance. As a result, an excessively rich or excessively lean fuel and air mixture is created, often resulting in less engine power, worsening of the quality of the exhaust, engine stalling, and other troubles.

An additional issue to consider is that regulations governing the emissions of multi-purpose engines, which have been put into effect in recent years, make it necessary to equip these engines with a limiting device that allows the user to make adjustments, after the manufacturer has adjusted the carburetor valves, substantially only within the range allowed by law. These devices must also be constructed such that they are difficult to remove from the carburetors.

Devices to limit the adjustment of the fuel adjustment valve have been described in the art. U.S. Pat. No. 3,618,906 describes a cap that has been installed on the end of the adjustment valve. The cap is equipped with a radially protruding appendage that limits adjustment to within one revolution because the appendage is obstructed by the carburetor body acting as a stopper. U.S. Pat. No. 5,236,634 describes valves for both the main fuel jet and the low-speed fuel jet as being placed parallel and adjacent to each other and having a cap with an appendage being obstructed by the other adjustment valve, or its extension acting as a stopper.

However, both of these valve adjustment limitation devices protrude from the carburetor body. Their exposure makes it easier for the user to remove them with a bit of ingenuity. Thus, these devices do not prevent deliberate and resolute tampering by the user.

Other shortcomings with these designs exist during the manufacturing process. Either the valves have to be assembled provisionally so as not to slip out prior to adjustment and, after adjustment of the valves, the cap is installed permanently in a position where its appendage is in contact with the stopper, or the valves are installed only after adjustment with the appendage of the cap in a position in contact with the stopper, without provisional assembly. Not only is it difficult to assemble the very small parts one by one, by hand, but in some cases the appendages are not positioned correctly in relation to their stoppers. This results in some carburetors having a wider adjustable range in one direction, which could possibly produce an excessively rich or excessively lean mixture and make it substantially possible to operate outside the legal limit for emissions.

Therefore, it would be desirable to have a limiting device for a carburetor, having manually adjustable valves placed parallel and adjacent to each other and that are able to adjust the effective cross-sectional area of the main and low-speed fuel jets separately, being capable of preventing deliberate and resolute tampering by the user, eliminating the difficulty in handling small parts, and preventing the emissions, when the engine is being used in a normal manner, from exceeding the legal limitations due to an inaccurate setting made by the manufacturer.

SUMMARY OF THE INVENTION

A primary objective of the present invention is to provide a fuel adjusting device that comprises limiting caps that are engaged with the extensions of fuel adjustment valves and possess radially protruding appendages whose rotation is obstructed by stoppers, that prevents tampering by the user, that is easy to handle, and that allows the user to make adjustments only within the limits of the emission regulations.

In an exemplary embodiment of the present invention, the components are easier to handle and the possibility of deliberate tampering by the user is reduced because the caps are pressed into a retainer that is fixed onto the carburetor body. In addition, the appendage and stopper construction along with the predetermination of the respective retaining positions of the caps within the retainer, enable the user to make adjustments substantially only within a range of allowable emissions.

In order to achieve such objectives, the limiter caps of the present invention have insertion holes for a tool to pass through to adjust the valve. At the end of the insertion holes, there are engagement areas where the caps become attached to the valves. Once engaged, the cap and valve act as one unit, moving together when turned. At the base ends of each cap, there are primary and secondary appendages, that protrude radially from positions predetermined by necessary phasing, and that separately limit turning in both the direction that creates a richer mixture and the direction that creates a leaner mixture.

The retainer that is attached to the carburetor body allows room for the caps to remain in a position in retention holes disengaged from the extensions of the adjustment valves. It is preferable that it not be possible for the caps to turn while in this disengaged position, but that the caps be able to move forward to engage the extensions of the adjustment valves.

In cases where only one cap is engaged onto the main fuel jet valve, the extension of the low-speed fuel jet valve, or a protrusion included in the structure of the retainer, becomes the stopper. The construction of the device is such that the stopper is located between the two appendages of the cap.

However, where caps are to be installed on both valves, each cap becomes a stopper for the other. The construction of the device being such that each cap is located between the two appendages of the opposite cap.

Furthermore, it is preferable to prevent the cap in the disengaged position from slipping out of the retention hole by installing a protrusion on the cap that prevents this, and by creating a cylindrical cut-out, having a smaller cross-section than that of the cap, to be used as the retention hole.

In addition, the cap preferably cannot be turned when in the disengaged position, but it is preferable that it be able to turn when inserted forward into the retention hole into the engaged position. When the cap is inserted through the retention hole, it is in a preferred position, such that the secondary appendage almost touches its stopper enabling the user to adjust substantially only in the leaner mixture direction.

Further, when two caps are employed, it is preferable that both the caps are of the same dimensions, are positioned such that they are at a 180 degree angle to each other in the disengaged position, and cannot be turned when inserted into the retention hole to be retained in the disengaged position.

The manufacturer adjusts the effective cross-sectional area of the fuel jet to a predetermined fuel flow quantity by adjusting the valve. This is accomplished by inserting a tool through the insertion hole of the cap while it is in the disengaged position in the retention hole. Next, the cap is pressed forward, engaging the cap with the end of the adjustment valve. From this point on, the cap and valve become securely attached to each other and move in unison, thus allowing the user to make adjustments substantially only within the range defined by the opening between the appendages. The cap is also held within the retainer hole of the retainer and is not completely exposed, thus making it more difficult to be removed.

DETAILED DESCRIPTION OF THE PREFERRED EMBODIMENT

Figure 1:
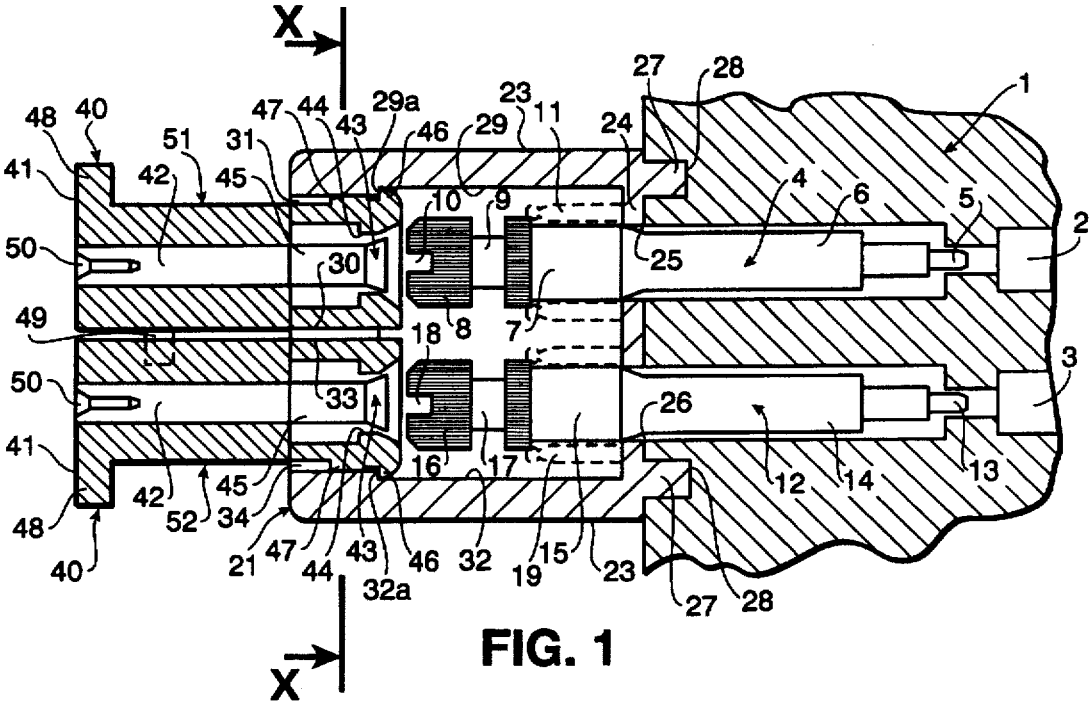
FIG. 1 is a cross-sectional view of an embodiment of the present invention in a disengaged position.

Referring now in detail to the drawings, there is illustrated a novel carburetor fuel adjusting device for a general purpose engine carburetor according to the present invention. Turning to FIGS. 1 to 5 to describe an embodiment of present invention, fuel flows from a diaphragm or float chamber, not shown, through an intake passage, also not shown, that leads to a main fuel jet 2 and a low-speed fuel jet 3, and on through to a main nozzle, an idling port, and a slow port, also not shown. The effective areas of the main and low-speed fuel jets 2 and 3 are adjusted separately by manual adjustment valves 4 and 12, which are placed parallel and adjacent to each other.

The adjustment valves 4 and 12 comprise tapered needle valves 5 and 13 inserted into the fuel jets 2 and 3, threaded rods 6 and 14 screwed into a carburetor body 1, valve extensions 7 and 15 that protrude from the carburetor body 1. The valve extensions 7 and 15 are knurled at their ends in a straight pattern parallel to their longitudinal axis to create knurled heads 8 and 16 adjacent cap lock grooves 9 and 17 in the valve extensions 7 and 15. In addition, tool slots 10 and 18, which are used for making valve adjustments, are located in the end of the knurled heads 8 and 16.

A retainer 21, preferably made of hard plastic, is substantially box-shaped and comprises a bottom wall 22, side walls 23, and a contact wall 24. The contact wall 24 possesses two assembly protrusions 27 that fit hermetically into two assembly holes 28 in the carburetor body 1. Loosening prevention springs 11 and 19, which are inserted between valve extensions 7 and 15 and the contact wall 24, continually push the contact wall 24 onto to the carburetor 1, fixing the retainer 21 onto the carburetor 1.

Adjacent the contact wall 24 of the retainer 21 and the end of the carburetor body 1 are two cylindrical cut-outs 29 and 32 within the retainer 21. The extensions 7 and 15 of the adjustment valves 4 and 12 are located within the cutouts 29 and 32, with the adjustment valves 4 and 12 extending through extension holes 25 and 26 in the contact wall 24. Retention holes 30 and 33 are located within the retainer 21 adjacent the cutouts 29 and 32 and away from the contact wall 24. The retention holes 30 and 33 are connected at the sides by a passage 35*a*, that is located at the base of a split groove 35 which opens on the side of the retainer 21 opposite the bottom wall 22. The retention holes 30 and 33 are totally round, but are slightly smaller in diameter near the cylindrical cut-outs 29 and 32. Also, grooves 31 and 34 are cut along the length of retention holes 30 and 33 respectively, at positions located 180 degrees with respect to each other.

A cap 40 preferably is made of hard plastic. A tool used for the adjustment of the adjustment valves 4 and 12, usually a screwdriver, can be inserted into an insertion hole 42 in the cap 40. The insertion hole 42 is a cylinder with an engagement area 43 located at the end of the insertion hole 42 opposite a base end 41 of the cap 40. The engagement area 43 comprises grips 44 and two protruding areas 45 that are located reciprocally and at an angle of 90 degrees to each other. The engagement grips 44 fit into the cap lock grooves 9 and 17 of the extensions 7 and 15 of the adjustment valves 4 and 12, while the knurled heads 8 and 16 of the extensions 7 and 15 are enveloped by the protruding areas 45. The protruding areas 45 are of a slightly smaller diameter than the knurled heads 8 and 16 of the valve extensions 7 and 15.

Also, a detachment prevention lip 46 is formed on the outer surface of the rim of the end of the cap 40 and comes in contact with inner surfaces 29*a* and 32*a*, adjacent the split groove 35 and formed by the cylindrical cut-outs 29 and 32. A key 47 is similarly formed longitudinally along the outer surface of the end of the cap 40 and fits into grooves 31 and 34 in positions located 180 degrees in relation to each other.

In addition, installed on the outer surface of the base end 41 of the cap 40 are two wing-shaped appendages 48 and 49 that are out of phase with each other and staggered in relation to each other longitudinally along the axis of the cap 40. For example, a primary appendage 48 is located nearest the base end of the cap 40 and sweeps an angle from 0° to 90°, approximately, while a secondary appendage 49 is spaced away from the primary appendage 48 longitudinally along the axis of the cap 40 and sweeps an angle from 90° to 180°, approximately. The primary appendage 48 limits the turning of the valve in the lean direction, and the secondary appendage 49 limits turning in the rich direction.

When the caps 40 are pressed into the retention holes 30 and 33, the detachment prevention lips 46 are located in a position in contact with the inner surfaces 29*a* and 32*a* of cylindrical cut-outs 29 and 32 preventing the caps 40 from slipping out of the retainer 21 when in the disengaged position (see FIG. 1). At this time, because the diameter of the retention holes 30 and 33 is smaller in the area near the inner surfaces 29*a* and 32*a*, the caps 40 are squeezed and pressed upon, and because of the mutual action of the grooves 31 and 34 and keys 47, the caps 40 are retained and maintained in a state in which they cannot be turned.

By fixing the retainer 21 on the carburetor body 1 and configuring the retainer 21 to maintain the caps 40 at predetermined angles in relation to each other in the disengaged position, not only are the caps 40 easy to handle, but there is no need to worry about forgetting to install the caps 40. Once the caps 40 are installed, it is possible for the user to substantially only adjust the adjustment valves 4 and 12 within the range of emission regulation limitations.

While the caps 40 are in the disengaged position within the retainer 21, the manufacturer inserts a tool in the insertion hole 42 to engage the tool slots 10 and 18 in the end of knurled heads 8 and 16, and adjust, separately, the effective cross-sectional area of the two fuel jets 2 and 3 by adjusting adjustment valves 4 and 12. The adjustment to the valves 4 and 12 is made freely without the caps 40 interfering in any way. The carburetor, adjusted by its manufacturer, is then installed on an engine where the engine manufacturer can make further wide-range adjustments while measuring the CO concentration of the engine's emissions.

When the final adjustment has been completed, pressing hard on the base end 41 of the caps 40 will cause the caps 40 to slide forward because the keys 47 are in the grooves 31 and 34. In the engagement area 43 of the insertion hole 42 of the caps 40, the engagement grips 44 fit into the cap lock grooves 9 and 17, and, at the same time, protruding area 45 will envelop the knurled heads 8 and 16, thus engaging the valve extensions 7 and 15 such that the caps 40 can neither move longitudinally nor rotationally relative to the valve (see FIG. 5). At this point, the key 47 leaves the grooves 31 and 34, and the cap 40 becomes engaged and integrated with valves 4 and 12 so as to turn in unison with the valves 4 and 12.

Thus, the user receives the carburetor with caps 40 integrated and turning together with adjustment valves 4 and 12, that is to say, in a final stage of assembly. The user can insert tools through insertion holes 42 to engage the tool slots 10 and 18 in the end of knurled heads 8 and 6, or use a tool to engage engagement slots 50 in the base end 41 of the caps 40 to make further adjustments to the adjustment valves 4 and 12. These adjustments change the effective cross-sectional area of the fuel jets 2 and 3 while maintaining emissions within regulations.

Figure 2:
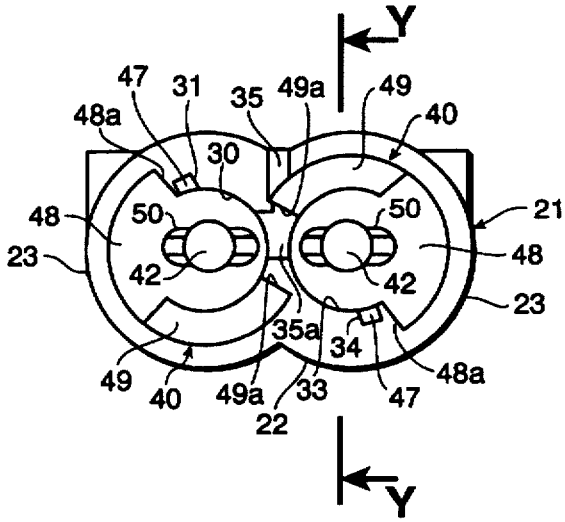
FIG. 2 is an end view viewed from the left side in FIG. 1 and rotated 90°.
Figure 3:
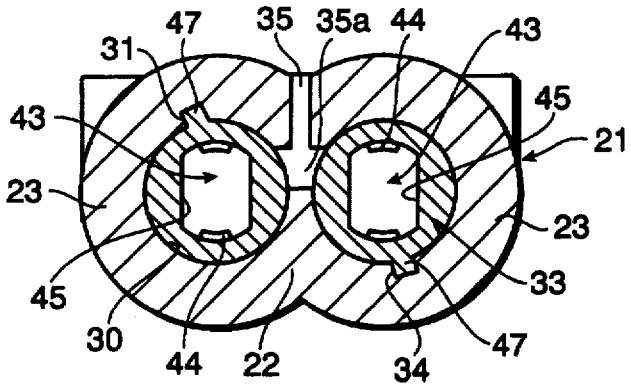
FIG. 3 is a cross-sectional view along a line X—X in FIG. 1 and rotated 90°.
Figure 4:
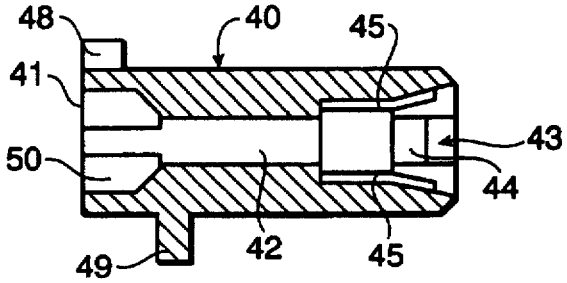
FIG. 4 is a cross-sectional view of a cap cut along a line Y—Y in FIG. 2.
Figure 5:
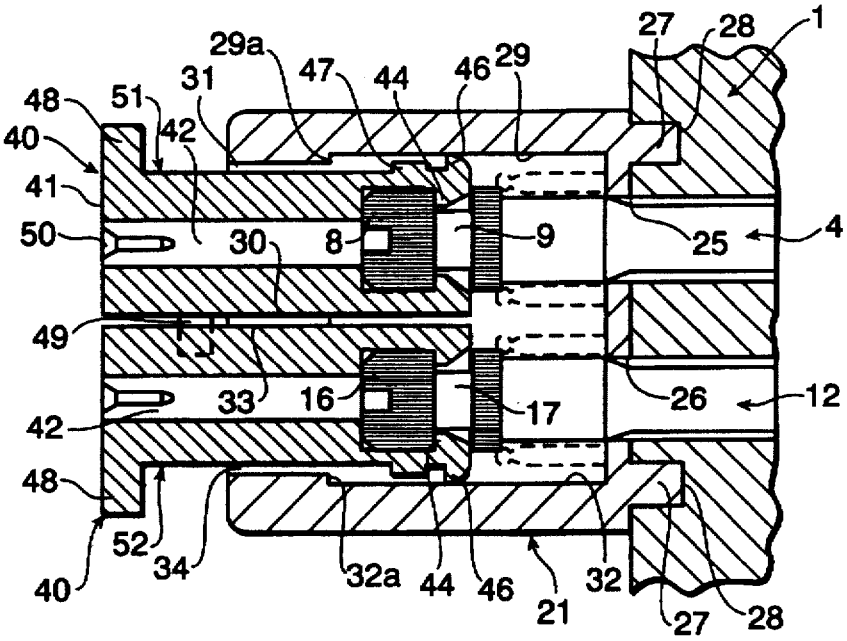
FIG. 5 is a cross-sectional view of an embodiment of the present invention in an engaged position.

As shown in FIG. 2, the caps 40 are inserted into the retention holes 30 and 33 in such a position that the edge 49*a* of the secondary appendage 49, which limits turning in the rich mixture direction for each of the two caps 40, is almost in contact with the outer surface of the other cap 40. As a result, when the caps 40 are pressed forward and engaged with extensions 7 and 15, it becomes extremely difficult, if not impossible, to make adjustments in the direction that increases the effective cross-sectional area of the fuel jets 2 and 3, the "rich" direction.

On the other hand, it is possible to turn in the direction that decreases the effective cross-sectional area of fuel jets 2 and 3, the "lean" direction, to a point where the edge 48*a* of the primary appendage 48 comes in contact with the other cap 40. Therefore, by setting the turning angle range for the appendage 48 appropriately, and having the partner caps 40 acting as stoppers 51 and 52 for each other, the adjustments in the lean mixture direction, which does not increase the concentration of CO in the engine's emissions, can be made within the range of emission regulations.

It is also possible to adjust the range of emissions in either the lean or the rich mixture direction by opening the angle between the edges 48*a* and 49*a* of appendages 48 and 49.

Since the tips of the caps 40 are surrounded in three directions by the bottom wall 22 and side walls 23 of the retainer 21, and the middle part is retained within the retention holes 30 and 33, the caps 40 are not easily detached without destroying the retainer 21. Thus, the embodiment of the present invention tends to prevent a user's deliberate and resolute tampering.

Figure 6:
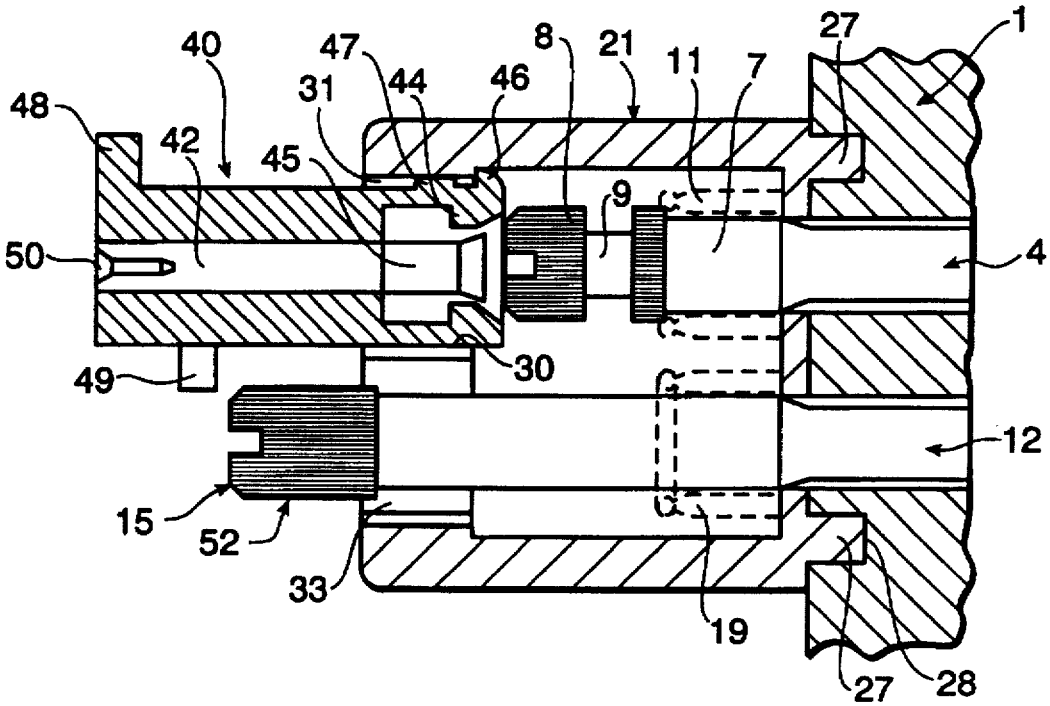
FIG. 6 is a cross-sectional view of an alternative embodiment of the present invention.

In the embodiment described above, the user is able to limitedly adjust both of the adjustment valves 4 and 12. Turning to FIG. 6, an alternative embodiment is shown in which the user can freely adjust the adjustment valve 12 of the low-speed fuel jet 3. The extension 15, of the adjustment valve 12, protrudes from the location of the retention hole 33 of the retainer 21 in the previous embodiment, while on the adjustment valve 4 of the main fuel jet 2 side of the retainer 21, the cap 40, described above, is arranged and inserted into the retention hole 30. As above, the angle between the two appendages 48 and 49 of the cap 40 determine the effective cross-sectional area of the main fuel jet 2. The adjustment valve 4 is rotated within the range of the fixed angle between the appendages 48 and 49 and is limited by using the extension 15 arranged between the appendages 48 and 49 as a stopper 52.

Figure 7:
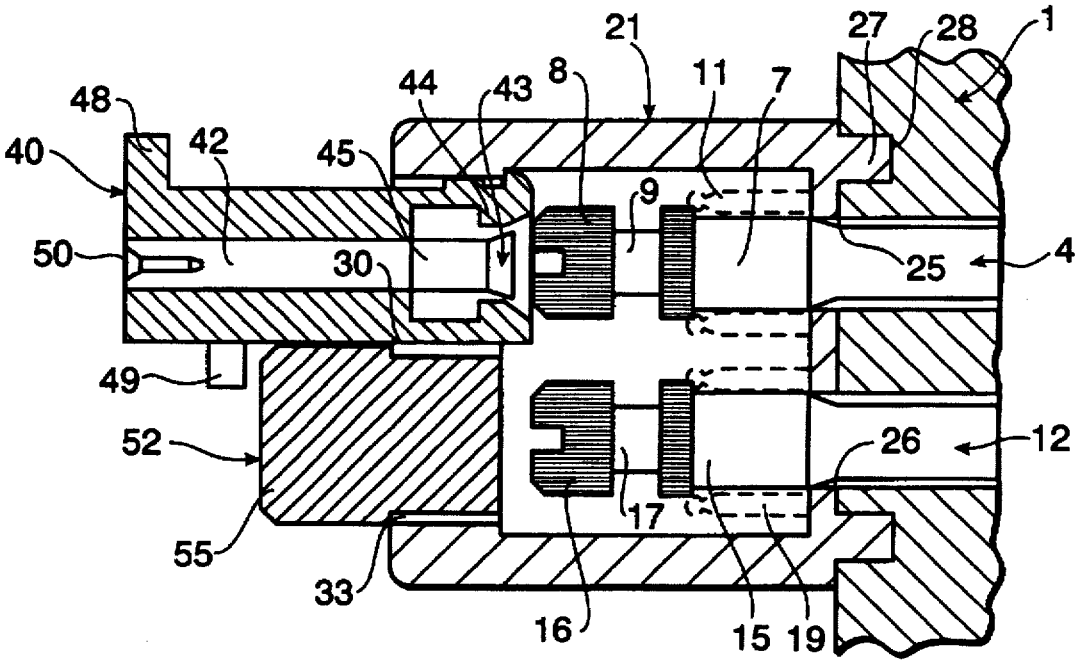
FIG. 7 is a cross-sectional view of another alternative embodiment of the present invention.

FIG. 7 shows another alternative embodiment wherein the user is not allowed to adjust the low-speed adjustment valve 12. A blank cap which comprises a protrusion 55 is attached to adjustment valve 12 in retention hole 33 of the retainer 21, making it substantially impossible to adjust the adjustment valve 12. The cap 40 of the previous embodiment is inserted in retention hole 30 and attached on the main fuel jet adjustment valve 4. The two appendages 48 and 49 of the cap 40 use the adjacent protrusion 55 as a stopper 52, and allow adjustment of the effective cross-sectional area of the main jet 2 by adjusting the adjustment valve 4 within a predetermined range defined by the angle between the appendages 48 and 49.

The embodiments illustrated and described in FIGS. 6 and 7 utilize the retainer 21 and the caps 40 of the embodiment illustrated and described in FIGS. 1 to 5 without substantial modification. Other variations of the embodiment of the present invention can be utilized on different types of carburetors, offering advantages in production and cost control.

Furthermore, it is possible to attach the retainer 21 to the carburetor body 1 with threads or by using adhesives. Other variations are also possible, such as enclosing adjustment valves 4 and 12 from all sides, using perfect cylinders for the retention holes 30 and 33 without cutting out any portion, or making the two appendages 48 and 49 into one integrated part.

In an additional embodiment (not shown), the cap 40 can be configured so that it freely turns in the disengaged position for adjustment during the manufacturing phase. Before handing the carburetor or engine over to the user, the two stoppers 51 and 52 can be adjusted in relation to the appendages 48 and 49. The cap 40 is, as above, pressed forward to engage the knurled head 8 and 16, thus limiting rotation of the valves 4 and 12 to follow emission regulations.

As should be clear from the above explanation, the cap 40 constitutes an adjustment valve 4 and 12 limiting system. By installing the cap 40 into the retainer 21 which is attached to the carburetor body 1, the small cap 40 becomes easy to handle, the concern about the possibility of forgetting to install the cap 40 diminishes, and the likelihood of deliberate and resolute tampering by the user is substantially deterred. Further, by setting the angle between the two appendages 48 and 49, which are installed on the cap 40 to limit turning in the lean mixture direction and in the rich mixture direction, and the relative angles of insertion in the retention holes 30 and 33 of the retainer 21 correctly, the user is substantially only able to adjust the adjustment valves 4 and 12 within the range of emission control regulations, using the protruding area 55 on the retainer 21 or the other cap 40 as stoppers 51 and 52. Therefore, with the carburetor fuel adjusting device of the present invention, the user can adjust the air-fuel mixture while limiting the risk of problems such as power decrease, worsening of the exhaust gas quality, or engine stoppage resulting from an overly lean or overly rich mixture.

While the above description contains many specificities, these should not be construed as limitations on the scope of the invention, but rather as an exemplification of preferred embodiments thereof. Other variations are possible.

Accordingly, the scope of the present invention should be determined not by the embodiments illustrated above, but by the appended claims and their legal equivalents.

What is claimed is:

1. A fuel adjustment device for a carburetor comprising a body, manual adjustment valves that regulate separately the effective cross-sectional area of a main fuel jet and a low-speed fuel jet in said body of the carburetor, said adjustment valves are located parallel and adjacent to each other and have extensions extending beyond said body, an adjustment limiting device comprising a cap having radial protruding appendages, said cap engaging said extension of said adjustment valve for the main fuel jet in an engaged position and capable of moving in unison with said adjustment valve while in the engaged position, a stopper located adjacent said cap and between said radial appendages of said cap, said stopper obstructing revolution of said radial appendages, and a retainer attached to said body of the carburetor and disposed over said extension of said adjustment valve for the main fuel jet, said retainer having a retention hole therein adapted to receive and retain said cap in a disengaged position adjacent said extension of said adjustment valve.

2. The fuel adjustment device of claim 1, wherein said radial appendages further comprise a primary appendage protruding in a radial direction from a base end of said cap, said primary appendage being adapted to limit the revolution of said cap in a direction that creates a leaner fuel and air mixture, and a secondary appendage protruding radially from said cap, said secondary appendage located in spaced relation with said primary appendage longitudinally along the axis of said cap and in out-of-phase relation with said primary appendage.

3. The fuel adjustment device of claim 1, further comprising a retainer attached to said body of the carburetor and placed over said extensions of said adjustment valves for the main fuel jet and the low fuel jet, said retainer having retention holes therein being adapted to each receive and retain said cap in a disengaged position adjacent said extension of said adjustment valves.

4. The fuel adjustment device of claim 3, wherein said stopper further comprises a protrusion extending from said retention hole of said retainer in line with said extension of said adjustment valve for the low-speed fuel jet.

5. The fuel adjustment device of claim 1, wherein said cap further comprises an insertion hole therethrough for a tool to pass to make adjustments to said adjustment valve.

6. The fuel adjustment device of claim 5, wherein said insertion hole further comprises an engagement area adjacent said extension of said adjustment valve enabling said cap to engage said extension of said adjustment valve and move in unison with said adjustment valve.

7. The fuel adjustment device of claim 6, wherein said engagement area further comprises a protrusion to prevent said cap from slipping from the engaged position with said extension of said adjustment valve.

8. The fuel adjustment device of claim 1, further comprising a recess in one of said cap and said retention holes of said retainer, and a protrusion on the other one of said cap and in said retention holes of said retainer, said recess and protrusion being constructed and arranged to prevent rotation of said cap when said cap is received and retained in said retention holes in the disengaged position.

9. The fuel adjustment device of claim 1, wherein said retention hole comprises a cylindrical cut-out having a smaller cross-sectional area than said cap.

10. A fuel adjustment for a carburetor comprising a body, manual adjustment valves that regulate separately the effective cross-sectional area of a main fuel jet and a low-speed fuel jet in said body of the carburetor, said adjustment valves are located parallel to each other and have extensions extending beyond said body, an adjustment limiting device comprising a cap engaging the ends of each of said extensions of said adjustment valves in an engaged position and capable of moving in unison with said valves while in the engaged position, appendages radially protruding from said cap, a stopper obstructing the revolution of said appendages on said cap, said stopper being located between said appendages of said cap on said extension of the other of said adjustment valves, and a retainer attached to said body of the carburetor and disposed over said extensions of each of said adjustment valves, said retainer having retention holes therein adapted to receive and retain said cap in a disengaged position adjacent said extensions of said adjustment valves.

11. The fuel adjustment device of claim 10, wherein said retention holes comprise cylindrical cut-outs having a smaller cross-sectional area than said cap.

12. The fuel adjustment device of claim 10, wherein said radial appendages further comprise a primary appendage protruding in a radial direction from a base end of said cap, said primary appendage being adapted to limit revolution of said cap in a direction that creates a leaner fuel and air mixture, and a secondary appendage protruding radially from said cap, said secondary appendage located in spaced and out-of-phase relation with said primary appendage longitudinally along the axis of said cap.

13. The fuel adjustment device of claim 10, wherein said stopper further comprises a protrusion extending from said retention hole of said retainer in line with said extension of said adjustment valve for the low-speed fuel jet.

14. The fuel adjustment device of claim 10, wherein said cap further comprises an insertion hole therethrough for a tool to pass to make adjustments to said adjustment valve.

15. The fuel adjustment device of claim 14, wherein said insertion hole further comprises an engagement area adjacent said extensions of said adjustment valves enabling said cap to engage said extensions of said adjustment valves and move in unison with said adjustment valves.

16. The fuel adjustment device of claim 15, wherein said engagement area further comprises a protrusion to prevent said cap from slipping from an engaged position on said extensions of said adjustment valves.

17. The fuel adjustment device of claim 10, further comprising a recess in one of said cap and said retention holes of said retainer, and a protrusion on the other one of said cap and in said retention holes of said retainer, said recess and protrusion being constructed and arranged to prevent rotation of said cap when said cap is received and retained in said retention holes in the disengaged position.

18. The fuel adjustment of claim 10, wherein said cap for each of said adjustment valves has identical dimension and form, said cap of each of said adjustment valves being received and retained in said retention holes of said retainer in the disengaged position 180° out-of-phase with respect to each other, and said cap further comprising a protrusion received within a recess in said retention holes to prevent rotation of said cap of each of said adjustment valves from rotating while in the disengaged position.

* * * * *